US005888182A

United States Patent [19]

Shih

[11] Patent Number: 5,888,182

[45] Date of Patent: Mar. 30, 1999

[54] ROTARY TORSO

[76] Inventor: Ching-Fu Shih, 31-42, Nan Tan Road, Sec. 2, Taichung, Taiwan

[21] Appl. No.: 889,572

[22] Filed: Jul. 8, 1997

[30] Foreign Application Priority Data

Mar. 28, 1997 [TW] Taiwan ..... 86204845

[51] Int. Cl.[6] ..... A63B 22/14

[52] U.S. Cl. ..... 482/147; 482/146

[58] Field of Search ..... 482/146, 147, 482/70, 79

[56] References Cited

U.S. PATENT DOCUMENTS

| | | | |
|---|---|---|---|
| 2,906,532 | 2/1959 | Echols | 482/146 X |
| 3,441,271 | 4/1969 | Palacios | 482/146 |
| 3,911,907 | 10/1975 | Smith | 482/147 X |
| 5,599,262 | 2/1997 | Shih | 482/146 X |
| 5,632,711 | 5/1997 | Hwang | 482/146 X |
| 5,695,439 | 12/1997 | Lin | 482/146 |

*Primary Examiner*—Jerome W. Donnelly
*Assistant Examiner*—William LaMarca
*Attorney, Agent, or Firm*—Burns, Doane, Swecker & Mathis, L.L.P.

[57] ABSTRACT

A rotary torso comprises: a frame with a base, several supporting columns vertically installed on the base, a U shape railing installed a little bit above the supporting columns, and a U shape handle installed at the top of the supporting columns; a hollow box shape rotating arm, with one rotatable end pivot installed by a shaft bearing at the central bottom of a fixed shaft; a rotating plate, with a rotatable central hub, supported at the rotating shaft at the free end of the rotating arm; and a driving structure installed inside the hollow part of the rotating arm.

The driving structure comprises: a driving sprocket installed at a rotating shaft supported by a shaft bearing at the free end of the rotating arm; a fixed sprocket installed at the fixed shaft on the same plane of the driving shaft; and a driving chain circularly suspended between the driving sprocket and the fixed sprocket, when the rotating plate rotates in one direction, the rotating arm rotates in the opposite direction of the rotating plate by the driving structure with the fixed shaft as a center.

The frame can be partly detached and folded into layers.

9 Claims, 6 Drawing Sheets

ROTARY TORSO

BACKGROUND OF THE INVENTION

1. Field of the Invention

The invention relates in general to a rotary torso, and more particularly to the improvement of a driving structure of a vertical rotary torso.

2. Description of the Related Art

There are various kinds of waist twisting instruments, and the swinging loop and the rotating plates are most common. In Taiwanese Patent No. 166930 (1991), a waist twisting and abdomen tightening body building instrument is disclosed. The driving structure of it consists of the follows. One end of it has a downward cam shaft which can rotate and scarf into the central bearing block of a base. The other end has a horizontal lever (rotating arm) in a bearing block of a upward cam shaft, and via a centrally downward cam shaft, a rotating plate can rotate freely and scarf into an upward bearing block at the other end of the lever. When users hold the handles installed at the protecting railing above the rim of the base, the feet stepping on the rotating plate and the waists twisting, the rotating plate rotates with the free end of the horizontal lever of the bearing block as the center. Meanwhile, the horizontal lever rotates according to body weights and the torque produced by the rotating force of the rotating plate. On the other hand, the rotating plate rotates eccentrically to the center of the base, and simultaneously rotates around the center of the base. This kind of theory of motion is very common in children's playing instruments in the scientific museum and the rotating cup in the fun fair.

However, to apply this structure in body building instruments for practical exercise, the rotating plate and the rotating arm are not related with each other, and rotate isotropically and irregularly with the axis of rotating plate and the rotating arm respectively. Therefore, the standing position of the users cannot be kept at the same location, and the body is and twisted. Especially, these two rotating parts trend to rotate faster and faster, thus cause the users hard to control and stand steadily, or even fall down. To prevent users to fall down, a three-way supporting abdomen tightening ring has to be installed to keep the body in balance. In addition, the above body building instrument cannot be folded, and this is inconvenient in storage and transportation.

SUMMARY OF THE INVENTION

According to the above consideration, the invention investigates the motion structure in order to make the rotating plate and the rotating arm act at a certain direction simultaneously, and to eliminate the isotropic free rotation. A design in which a rotating plate and a rotating arm rotate and spin by a driving structure is disclosed and approved in both Taiwanese Patent No. 84,215,533 and U.S. Pat. No. 576,687. With this design, users can move in a certain direction and keep their bodies in balance. In addition, this design is not only easy to operate and control, but also a safe rotary torso. However, after some experiments, it is found that to achieve the synchronized motion between the rotating plate and the rotating arm, the complicated indirect driving way is not necessary. A direct way is able to achieve the object. The instrument designed in this way can be folded and save the space of packaging, transportation, and storage.

It is therefore an object of the invention to provide a rotary torso, in which the driving structure is simplified, and the whole structure is simplified. Thus, the manufacturing cost is reduced.

It is another object of the invention to provide a rotary torso, no matter which way the rotating plate rotates, the bodies of users are always directed to the same way.

It is another object of the invention to provide a rotary torso, of which the frame can be easily disassembled and assembled.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
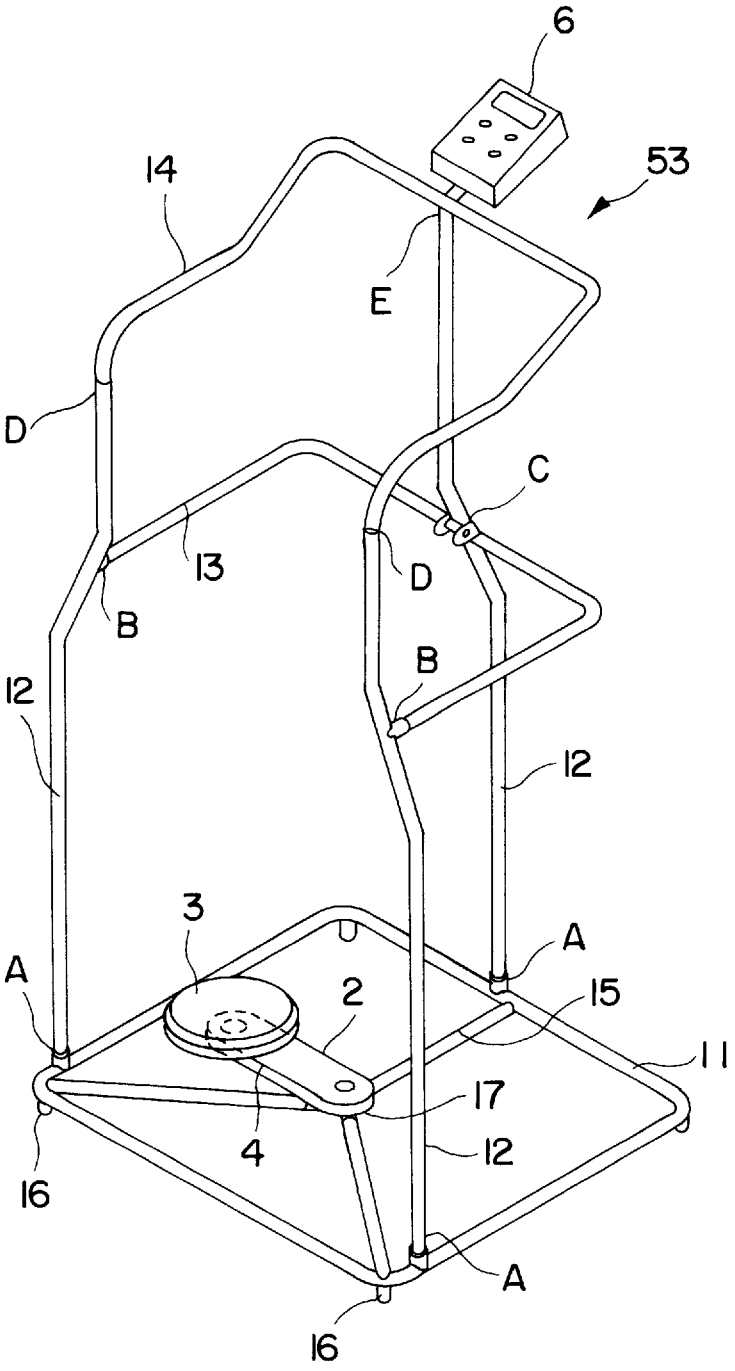
FIG. 1 (Prior Art) is a perspective view of the preferred embodiment.
Figure 2A:
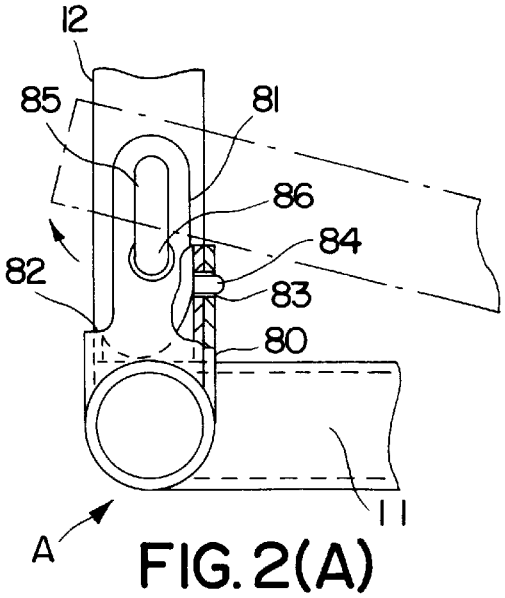
FIGS. 2A to 2E show the joints of a frame.
Figure 2B:
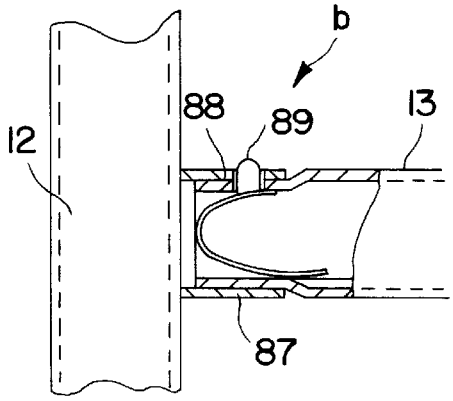
Figure 2C:
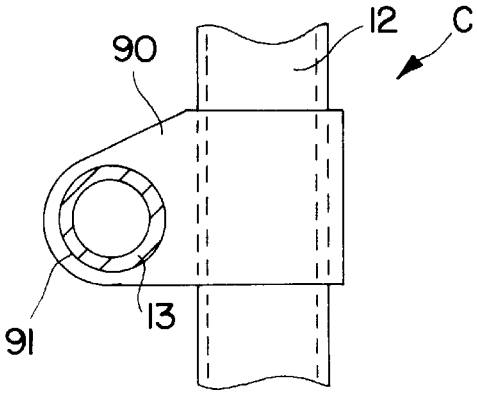
Figure 2D:
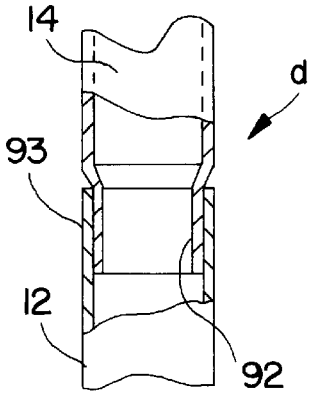
Figure 2E:
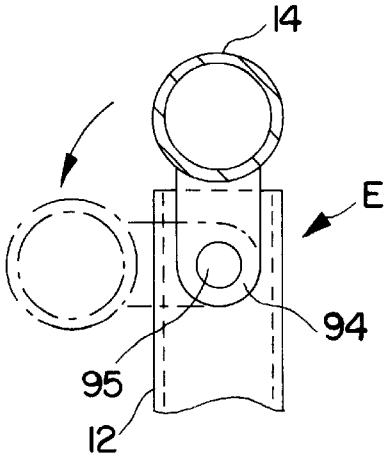

Referring to FIG. 1, a rotary torso comprises: a main frame 1 which is composed by: a base 11, three columns 12 vertically installed on the base 11, a railing 13 installed a little bit above the columns 12, and a handle 14 installed at the top end of the columns 12; a hollow box-shape rotating arm 2 with one end pivot installed on the fixed shaft 10, which is supported by several horizontal levers 15 installed at the center of the base 11; a rotating plate 3 which can rotate with the rotating axis 40 supported by the central hub of the free end of the rotating arm 2; a driving structure 4 installed inside the box of the hollowed box shape; and a brake 5 installed under the rotating arm 2 and above the fixed shaft 10.

Frame 1 consists of a base 11, which is normally a round shape or a polygonal shape ring frame, is preferred made of metal tube material. In the base, there are several feet and radial levers which (three levers in the embodiment) stretching from the rim of frame 1 towards the center, and joining at the fixed shaft 10 supported by radial levers 15 in the central tube 17. The supporting column 12 is in a bending shape. The lower end of the column 12 can be folded on the base 11 by the joint. The better distribution of these three columns 12 is with on column in front, and the other two in behind. A U shape railing with connecting lever 13 can be scarfed into the joint B of the two columns 12, thereof a foldable central part can be pivot jointed with the joint C of the front column 12. Two ends of a U shape handle 14 can be scarfed into the top ends D of the two columns 12 behind, thereof a center part can be foldable pivot jointed with the joint E installed at the top end of the front column. Thus, the whole frame 1 can be constructed as a foldable structure. To prevent users to step out of position, there are base plates covered on the base 11 (not shown on the figure). Only the rotating arm 2 and the rotating plate 3 are exposed above the base plate. There is a counter 6 at the top end of the front column 12.

Referring to FIG. 2, the joints A to E which enable frame 1 to be foldable are shown. Joint A is composed of a short tube 80 welded on a pair of corresponding shallow and deep notches 81, 82 on base 11; a spring pin 84 whose pin end can be scarfed into the pin hole on the short tube 70 installed inside the lower end of column 12; and a fixed pin 86 through the upper portion of the short tube 80 and a long hole 85 of the column 12 scarfed into the short tube. When the spring pin hole 84 is pushed away from the pin hole 83 inwardly and the column 12 is raised to the bottom of the notch 82, the column 12 falls towards the notch 81 and becomes a folded status by using the fixed pin as the pivot. Joint B is composed of a short tube welded at the front upper end of column 12; and a spring pin 89 installed inside the lower end of the protecting railing 13 and scarfed inside the pin hole 88 of the short tube 87. Joint C is composed of the U shape pivot joint plate. The center of the protecting railing 13 can rotate freely through the hole of the pivot joint plate 90. When two ends of the protecting railing 13 are disengaged from joint B, these two ends will fall by gravitation. By a short section of which the opening is roughly vertical of the upper end of the rear column 12, joint D is used to enable the end 92 with a smaller diameter of handle 14 to insert into the opening 93. When the end 92 of handle 12 is raised, it can be disengaged from column 12. Joint E is composed of a U shape pivot joint plate welded on the center of handle 14, and supporting column 12 at the top end; and a pivot pin 95 which pivot joint handle 14 and column 12 through the pivot joint plate 94 and supporting column 12.

Figure 3:
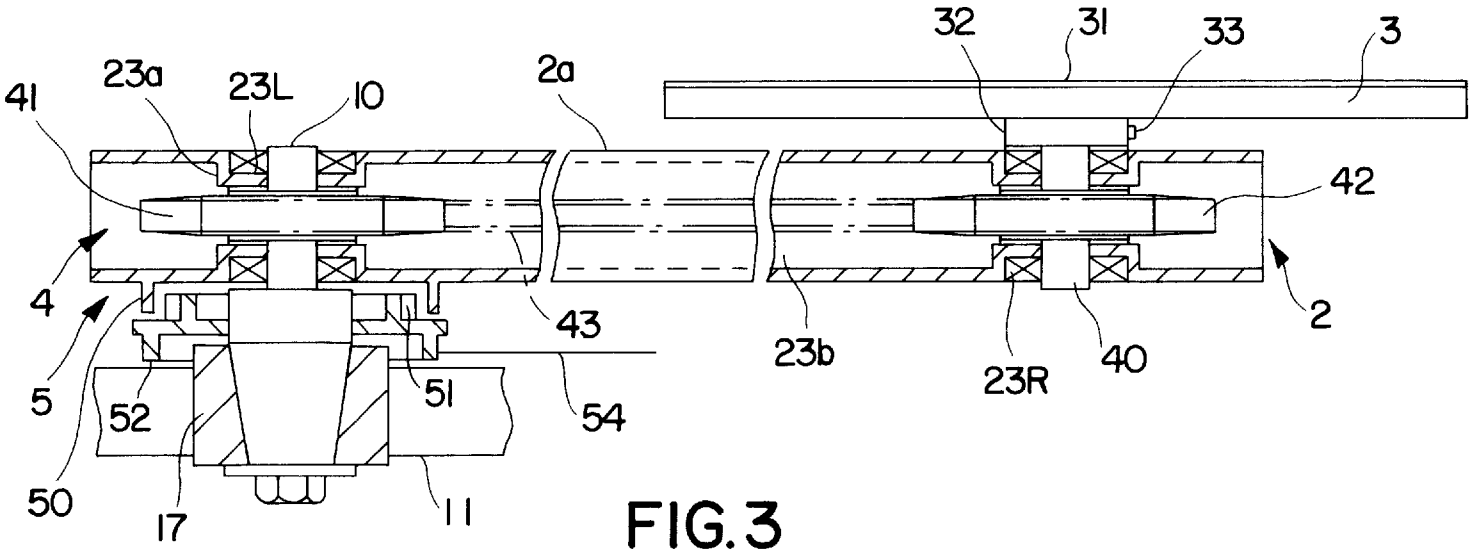
FIG. 3 is a cross-sectional view of a part of the main frame.

Referring to FIG. 3, the rotating arm 2 is a double rectangular box made of metal plate. That is, the rotating arm consists of upper and lower boxes 2*a* and 2*b* covered by each other. This structure is convenient for the assemble of a driving structure. There are upper and lower surfaces installed with a pair of corresponding shaft bearing containing parts 23*a* and 23*b* at the bottom end, that is, the pivot joint end of the bottom, and the free end, that is, the end installed with a rotating plate of the rotating arm 2 (upper and lower boxes 2*a* and 2*b*). Inside of the containing parts 23*a* and 23*b* there are shaft bearings 23L, 23R scarfed by a tight match. There is a cylinder brake drum 50 installed at the outer rim around the lower end of shaft bearing 23L. The rotating arm can rotate freely with the shaft bearing 23L at the bottom end scarfed with the fixed shaft 10 inside the central tube 17 scarf installed on the base 11. In addition, there is a rotatable shaft 40 installed inside the shaft bearing 23R at the free end of the rotating arm 2.

Rotating plate 3 is a round plate with radius smaller than the length of rotating arm 2. The surface of rotating plate 3 is preferred to be a anti-slide rough face, or covered by a plastic anti-slide pad 31, to avoid the users slip from the plate. There is a cylinder hub 32 at the center under the rotating plate 3. The rotating plate 3 rotate by scarfing the center of hub 32 at the top end of rotating shaft 40. With a screw 33 vertically screwed through the tap hole on the side wall to the front end of hub 32 to drag the flat side of shaft 40, the rotating plate 3 can be assembled and dissembled on the shaft 40. Thus, the rotating plate 3 which support the rotating arm 2 can rotate freely via shaft 40.

Figure 4:
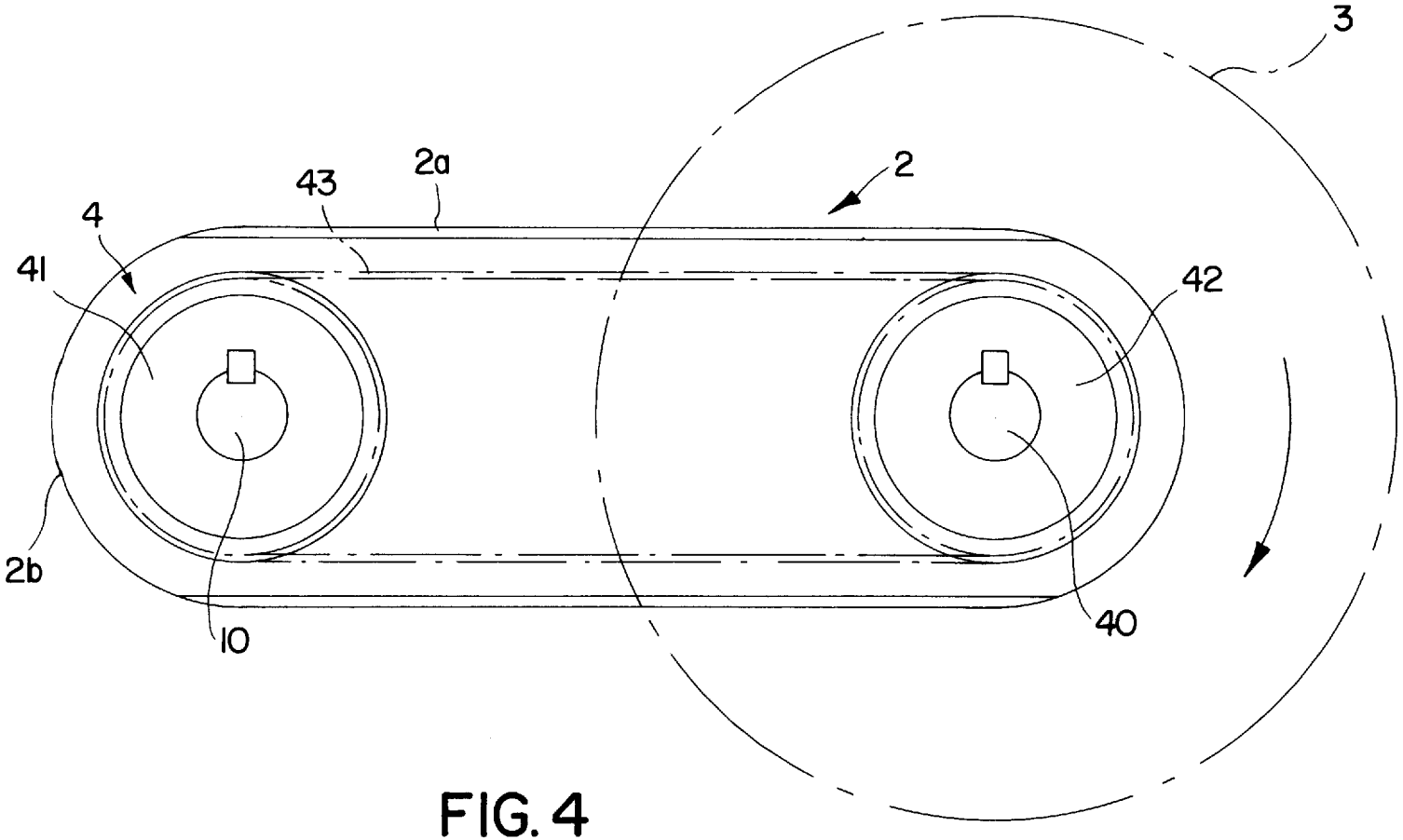
FIG. 4 is a top view of a part of the main frame shown in FIG. 3.

Referring to FIG. 2 and FIG. 4, the driving structure is presented. The driving structure installed inside the hollow part of rotating arm 2, is composed of: a driving sprocket 42 fixed in the rotating shaft 40 between the upper and lower shaft bearing 23R; a fixed sprocket 41 installed in the fixed shaft 10 between the upper and lower shaft bearing 23L on the same plane of sprocket 41; and a driving chain 43 circularly suspended both driving sprocket 42 and fixed sprocket 41. The numbers of teeth of sprocket 41 and sprocket 42 are the same. Therefore, when rotating plate 3 rotates a circle in one direction with shaft 40 as the center, the driving sprocket 42 installed in the same shaft 40 rotates one circle in the same direction. The rotating arm 2 dragged by the driving chain rotates one circle around fixed sprocket 41 in the opposite direction. That is, when rotating plate 3 rotates a certain angle in one direction, the rotating arm rotates the same angle in the opposite direction. Thus, when the rotating arm 2 rotates at any angle in any direction, the rotating plate 2 is kept at a certain direction, and the bodies of users are kept in the same direction in balance. If the numbers of teeth of sprocket 41 and 42 are different, users have to move their bodies and direction to keep in balance.

Brake 5 is installed between the bottom of rotating arm 2 and fixed shaft 10 of base 11, and it comprises brake drum 50 mentioned above and a expanding brake block 51. One end of this brake block 51 is fixed near the fixed shaft 10 of base 11 by a fixed pin. At the other end, one end of a brake lever 53 is fixed which enables the brake block 51 to open outwards and closely connected with the surface inside the brake drum 50, and thus stops the brake drum 50. The other end of the brake lever 53 is led by a brake cable 54 through the base 11 and the central column 12 of the railing 13, and pivot jointed with one end of the brake handle 55 on the railing 13.

Figure 5:
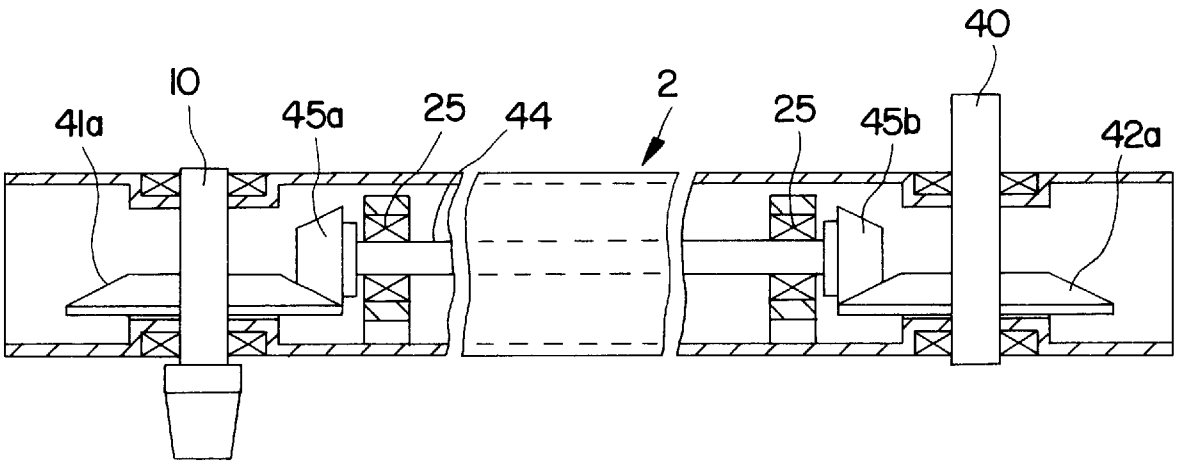
FIG. 5 shows another preferred embodiment of a driving structure.

In this embodiment, an expanding type brake block is adopted in brake 5. Other types, such as the strap type, external block type, and cassette type can be used to replace the expanding type. In this embodiment, a sprocket and chain set is used in the driving structure 4 is. Other sets such as a synchronized belt and a gear set, a train of gears, or a normal V shape belt and a belt pulley set can also be used. However, for a precise and effective transmission, the chain, sprocket type, synchronized belt, gear types are preferred. Referring to FIG. 5, a driving structure according to the invention is presented. There are umbrella type gears 41*a* and 42*a* of the same teeth and shape fixed on fixed shaft 10 and rotating shaft 40 to replace the sprocket 42 and 41, respectively. By shaft bearings 25, gears 41*a* and 42*a* can rotate horizontally between two shaft bearings 25 and support the middle shaft 44, and are meshed with the umbrella shape gears 45*a* and 45*b* of the same size at two ends of middle shaft 44. In this structure, when rotating plate 3 is spinning, driven by the umbrella shape shaft set 41*a*, 45*a*, 45*b*, and 42*b*, the rotating arm 3 rotates an angle around the fixed shaft 10 in the opposite direction. The same effect as the sprocket and chain transmission is thus obtain. However, this structure is more complicated compared to the previous one.

Hereinafter, the condition during operation is describe:

During operation, the feet of users step on the rotating plate 3 and the hands hold the handles (railing) 14. While users stand steadily, the waists and the legs are twisted to let the rotating plate 3 rotates with the shaft 40 as the center in one direction. The rotating arm 2 is dragged by the driving chain 43 and rotates one circle around the fixed sprocket 41 in the opposite direction. The rotating arm 2 rotates is driven to rotate around shaft 10 in the opposite direction as the rotating plate 3. Since the teeth are the same in sprocket 41 and 42, no matter which angle the rotating plate rotates, the rotation of the rotating arm 2 is kept in the same direction. Thus, the users can exercise with face in front, and their bodies can easily be controlled and kept in balance. Keeping twisting waists this way, the rotating plate 3 is kept rotating, and the rotating arm 2 is kept rotating around the shaft 10. During the exercise, if the speed of the rotating plate 3 or the rotating arm is faster and faster, users can slow down the speed by using the brake handle 55. Via the brake cable 54 to control the brake drum 50, the speed of the rotating arm can be reduced to fit the speed of the users. The brake drum can even be stopped completely, thus, the instrument is stopped. If the users change the direction to twist their waists, the rotating plate 3 is directed in the other way, so does the rotating arm 2.

Figure 6:
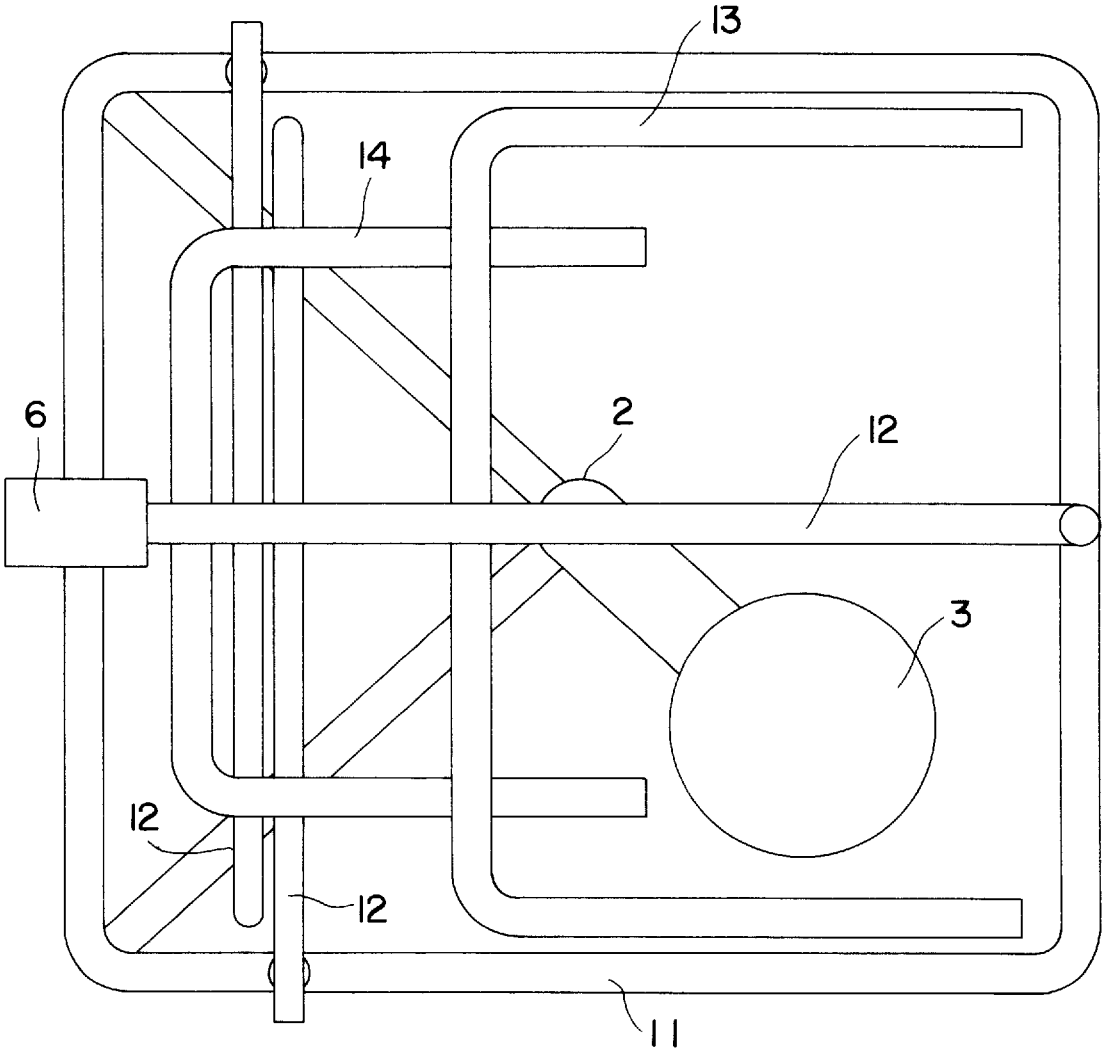
FIG. 6 is a top view of the folded status of a rotary torso in the invention.

After the operation, to fold the instrument, the joint D of the handle 14 is lifted to detach the column 12. The handle 14 is dropped and suspended on the column 12 by joint E. The pin is then pressed down and detached from the joint B of the railing 13. The railing 13 is dropped and suspended on the front column 12 by joint C. These three columns fall towards the base by the detachment of joint A. The frame 1 is then folded as shown in FIG. 6. It is convenient for storage and transportation.

Due to the above structure and operation, when users step on the rotating plate and exercise, the rotating arm rotates synchronized to keep the rotating plate in a certain direction. Also, users can control the speed by the operation of the brake to obtain the best adjustment. This instrument is thus safe to use. In the conventional instrument in which the rotating plate and the rotating arm rotate independently. Also, there is no way to control the speed, and thus, it is difficult to keep the users in balance. Users are easy to fall down. In addition, the frame can be folded easily to safe the space of storage.

While the invention has been described by way of example and terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

FIG. 1 (Prior Art) is a perspective view of the preferred embodiment;

FIGS. 2A to 2E show the joints of a frame;

FIG. 3 is a cross-sectional view of a part of the main frame;

FIG. 4 is a top view of a part of the main frame shown in FIG. 3;

FIG. 5 shows another preferred embodiment of a driving structure; and

FIG. 6 is a top view of the folded status of a rotary torso in the invention.

In the above figures, the numbers represent:

| | | | |
|---|---|---|---|
| 1 | Frame | 2 | Railing |
| 2 | Rotating Arm | 3 | Rotating Plate |
| 4 | Driving Structure | 5 | Brake |
| 10 | Fixed Shaft | 40 | Rotating Shaft |
| 41, 42 | Sprockets | 43 | Chain |
| 41a, 42a | Umbrellas Shape Gears | 45a, 45b | Umbrella shape gears |
| 41 | Middle Shaft | A~E | Joints |
| 6 | Counter | | |

What is claimed is:

1. A rotary torso exercise device, comprising:

a frame;

a rotatable hollow box shape rotating arm installed on a fixed shaft, with one end pivotally installed at the center of a base of the frame by a shaft bearing;

a rotating plate with a rotatable hub supported at a free end of a rotating shaft; and a driving structure installed inside a hollow part of the rotating arm, the driving structure including a driving sprocket fixed at a free end of the rotating arm on the rotating shaft supported by a shaft bearing, a fixed sprocket installed at the fixed shaft on a same plane of the driving sprocket and a driving chain circularly suspended around the outer circumference of the driving sprocket and the fixed sprocket, wherein when the rotating plate rotates in one direction, the rotating arm rotates in an opposite direction of the rotating plate by the driving structure with the fixed shaft as a center.

2. A rotary torso exercise device according to claim 1, further comprising a brake for controlling a speed of the rotating arm, and for stopping motion of the rotating arm.

3. A rotary exercise device according to claim 1, wherein the driving sprocket number of teeth and the fixed sprocket number of teeth of the driving structure are equal in number.

4. A rotary torso exercise device according to claim 1, wherein the driving sprocket number of teeth and the fixed sprocket number of teeth of the driving structure are unequal in number.

5. A rotary torso exercise device according to claim 1, wherein the frame includes a substantially square shape frame-type base, two supporting pivots installed in the rear two sides; a supporting pivot installed at a front central column on the base; a centrally rotatable U shape protecting railing, pivot jointed at an upper end of the front column, with two ends detachable from upper ends of the two rear columns; and a foldable and centrally rotatable U shape handle, pivot jointed at the upper end of the front column, with two ends detachable installed at the upper ends of the two rear columns.

6. A rotary torso exercise device according to claim 2, wherein the brake includes a brake drum concentrically installed at an outer rim of the shaft bearing, and a brake block fixed around the fixed shaft on the vase for cooperating with the brake drum.

7. A rotary torso exercise device, comprising:

a frame;

a rotatable hollow box shape rotating arm installed on a fixed shaft, with one end pivotally installed at the center of a base of the frame by a shaft bearing;

a rotating plate with a rotatable hub supported at a free end of a rotating shaft; and a driving structure installed inside a hollow part of the rotating arm, the driving structure consisting essentially of a first gear wheel arrangement fixed at a free end of the rotating arm on the rotating shaft, a second gear wheel arrangement installed at the fixed shaft on a same plane of the first gear wheel arrangement and a single drive member extending between the first and second gear wheel arrangements, wherein, when the rotating plate rotates in one direction, the rotating arm rotates in an opposite direction of the rotating plate by the driving structure with the fixed shaft as the center.

8. The rotary torso exercise device as set forth in claim 7, wherein the drive member is a belt.

9. The rotary torso exercise device as set forth in claim 7, wherein the drive member is a geared shaft.

* * * * *